US006593682B2

(12) United States Patent
Jung et al.

(10) Patent No.: US 6,593,682 B2
(45) Date of Patent: Jul. 15, 2003

(54) SPACER USING CROSS STRUCTURE AND FLAT PANEL DISPLAY USING THE SPACER

(75) Inventors: So-youn Jung, Seoul (KR); Jae-eun Jung, Seoul (KR); Jong-min Kim, Kyungki-do (KR)

(73) Assignee: Samsung SDI Co., Ltd. (KR)

( * ) Notice: Subject to any disclaimer, the term of this patent is extended or adjusted under 35 U.S.C. 154(b) by 412 days.

(21) Appl. No.: 09/726,514

(22) Filed: Dec. 1, 2000

(65) Prior Publication Data

US 2001/0013747 A1 Aug. 16, 2001

(30) Foreign Application Priority Data

Feb. 15, 2000 (KR) ..... 2000-7119

(51) Int. Cl.[7] ..... H01K 1/18
(52) U.S. Cl. ..... 313/292; 174/138 G
(58) Field of Search ..... 313/292, 238, 313/422, 496, 243, 495–497; 445/24, 25; 174/138 G, 158 R, 209

(56) References Cited

U.S. PATENT DOCUMENTS 5,561,343 A * 10/1996 Lowe ..... 313/482
5,842,897 A 12/1998 Jeong et al.
5,859,497 A * 1/1999 Anderson et al. ..... 313/495
5,910,703 A * 6/1999 Kuo et al. ..... 313/482
6,030,269 A * 2/2000 Drumm ..... 445/52
6,312,302 B1 * 11/2001 Na ..... 445/24

FOREIGN PATENT DOCUMENTS

JP 11-16494 11/1999

* cited by examiner

*Primary Examiner*—Robert H. Kim
*Assistant Examiner*—Jurie Yun
(74) *Attorney, Agent, or Firm*—Burns, Doane, Swecker & Mathis, L.L.P.

(57) ABSTRACT

A spacer using a cross structure, which is used to maintain the interval between two panels, for large flat panel display devices, and a flat panel display device using the spacer, are provided. This spacer includes a cross-rib type spacer obtained by combining a cross structure and a rib structure, and a cross-trapezoid type spacer obtained by combining a cross structure and a trapezoid rib structure. These spacer structures facilitate enlargement of panels by increasing the supporting strength while maintaining a high aspect ratio. Also, while these types of spacers are incorporated with a metal mesh, the distance between the mesh and a substrate is freely controlled according to the length of a cross structure, thereby improving the focusing of emitted electrons.

19 Claims, 8 Drawing Sheets

SPACER USING CROSS STRUCTURE AND FLAT PANEL DISPLAY USING THE SPACER

This application claims priority under 35 U.S.C. §§119 and/or 365 to 00-7119 filed in Korea on Feb. 15, 2000; the entire content of which is hereby incorporated by reference.

BACKGROUND OF THE INVENTION

1. Field of the Invention

The present invention relates to a spacer using a cross structure for maintaining the interval between two panels, and a large flat panel display adopting the spacer.

2. Description of the Related Art

A spacer supports a pressure put on a front substrate and a rear substrate of a flat panel display by the pressure difference between the inside of a vacuum space formed by two panels and the outside thereof due to the vacuum degree of the vacuum space. Also, a spacer maintains the interval between the front substrate and the rear substrate to be constant.

A spacer must have an insulation property since they contact a front substrate and a rear substrate to maintain the interval between the front substrate and the rear substrate, and also have a strength great enough to endure the pressure difference between the inside and outside of a panel caused depending on the vacuum degree of the inside of the panel. In order to satisfy the above-mentioned requirements, various materials such as ceramic, glass and the like can be used as a spacer material. Due to active research in display technology there has been a gradual increase in interest in the enlargement of panels. In relation to the enlargement of panels, the necessity of spacers, which can satisfy a high aspect ratio while sufficiently supporting a large panel, increases. In particular, with an increase in concern about the entire field of a display device technique, there is also an increasing trend toward the enlargement of panels of electric field emission display devices. In order to achieve enlargement of electric field emission display devices, there are many essential prerequisites. Among them, spacers must satisfy a prerequisite that they must not appear on a screen while sufficiently supporting a large panel.

FIG. 1 shows the structure of a conventional trench-type spacer. The trench-type spacer has a thickness of 70 $\mu$m and a height of 1100 $\mu$m for a panel of about 5 inches. When the trench-type spacer is installed between two panels, it is not bent, so it can be formed so as not to appear on the screen. However, when a spacer having the above-described existing specification is formed within the large panel, it may be bent by a high aspect ratio of the spacer, or bent or broken by the influence of the flow of a gas during an exhaust process after the space is formed. Thus, a fluorescent body on an anode is damaged. In order to solve this problem, the spacer must be thick. However, the thickness of the spacer must be reduced or below 70 $\mu$m since the spacer is required to have a high aspect ratio. When an existing spacer incorporates with a metal mesh which is used to prevent arcing, it fails to sufficiently endure the distortion of the mesh, so that it is easily broken. Hence, many problem are caused when spacers having an existing specification are applied to large panels. In elation to this fact, a new spacer, which can combine with mesh with a sufficient degree of robustness, and is not shown on a screen by reducing portions which contact the screen, is required in order to manufacture a large display panel.

SUMMARY OF THE INVENTION

To solve the above problems, an objective of the present invention is to provide a cross-rib spacer in which a cross structure and a rib structure or a trapezoid rib structure are coupled to a bar, and which sufficiently supports large panels and greatly reduces portions that contact a screen.

To solve the above problems, another objective of the present invention is to provide a flat panel display device adopting a spacer using a cross structure in which a cross structure and a rib structure or a trapezoid rib structure are mixed, the spacer made of ceramic or glass as in the prior art and having a sufficient degree of robustness by increasing a panel supporting area, so that the spacer is not easily bent or broken, and portions appearing on the screen are reduced, and the spacer capable of being treated as a single body by being coupled to a metal mesh.

To achieve the first objective, the present invention provides a spacer using a cross structure, including: a cross structure; a rib structure incorporated with the cross structure to constitute a supporter; and a bar structure for connecting the supporter comprised of the cross structure and the rib structure in alignment.

The cross structure, the rib structure and the bar structure are formed of glass or ceramic. Preferably, the supporter comprised of the cross structure and the rib structure are incorporated with a mesh without the bar structure.

Also, a trapezoid structure instead of the rib structure is combined with the cross structure to constitute a supporter. Here, it is preferable that the supporter comprised of the cross structure and the trapezoid structure are incorporated with a mesh without the bar structure.

To achieve the second objective, the present invention provides a flat panel display device adopting a spacer using a cross structure, the flat panel display device including a front substrate on which anode stripes and a fluorescent material are formed, and a rear substrate on which cathode stripes are formed in a direction perpendicular to the direction in which the anode stripes are formed, wherein the spacer using a cross structure includes: a cross structure; a rib structure incorporated with the cross structure to constitute a supporter; and a bar structure for connecting the supporter comprised of the cross structure and the rib structure in alignment, and wherein the spacer using a cross structure is installed so that the rib structure contacts the front substrate and the cross structure contacts the rear substrate.

Here, it is preferable that the cross structure, the rib structure and the bar structure are formed of glass or ceramic. Preferably, the supporter comprised of the cross structure and the rib structure are incorporated with a mesh without the bar structure.

Also, a trapezoid structure instead of the rib structure is combined with the cross structure to constitute a supporter. Here, it is preferable that the supporter comprised of the cross structure and the trapezoid structure are incorporated with a mesh without the bar structure.

The spacer using the cross structure is aligned over a spacer fixing frame formed on the edge of the rear substrate, and fixed to the spacer fixing frame by a paste. A side glass bar made of frit glass is inserted on the outer sidewall of the spacer fixing frame between the front substrate and the rear substrate, so that the front substrate and the rear substrate are packaged.

BRIEF DESCRIPTION OF THE DRAWINGS

The above objectives and advantages of the present invention will become more apparent by describing in detail preferred embodiments thereof with reference to the attached drawings in which.

DESCRIPTION OF THE PREFERRED EMBODIMENTS

The present invention provides a cross-rib type spacer structure and a cross-trapezoid type spacer structure. These spacer structures facilitate enlargement of panels by increasing the supporting strength while maintaining a high aspect ratio. Also, while these types of spacers are incorporated with a metal mesh, the distance between the mesh and a substrate is freely controlled according to the length of a cross structure, thereby improving the focusing of emitted electrons.

Figure 1:
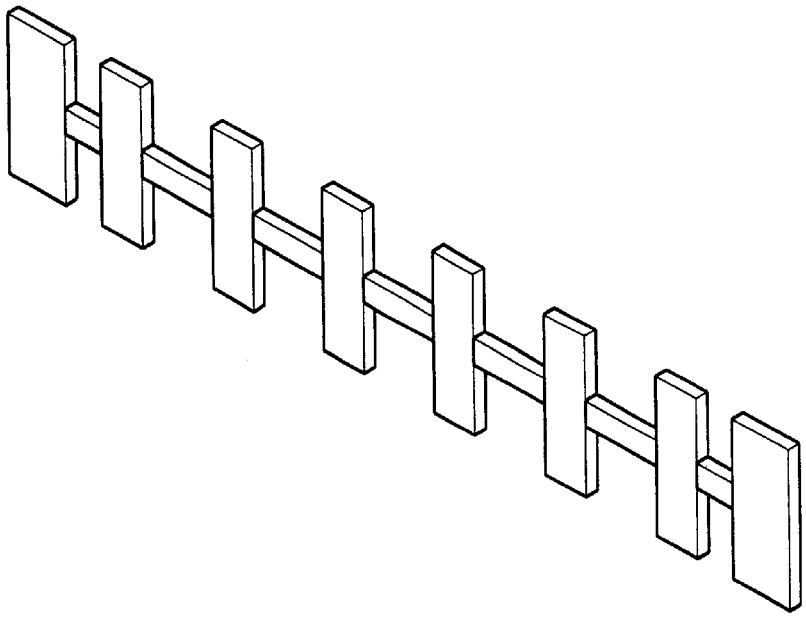
FIG. 1 (PRIOR ART)
FIG. 1 is a perspective view schematically illustrating the structure of an existing trench-type spacer.
Figure 2:
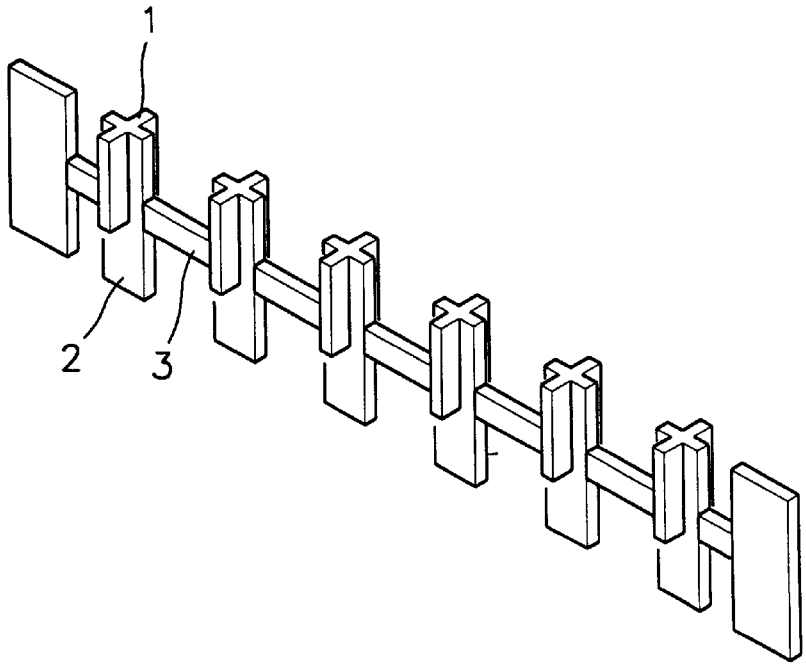
FIG. 2 is a perspective view of a first embodiment (a cross-rib type spacer structure) of a spacer structure using a cross structure according to the present invention.

FIG. 2 is a perspective view of a first embodiment of a spacer according to the present invention formed in consideration of a high aspect ratio. As shown in FIG. 2, the first embodiment has a structure in which support structures (1+2), each of which is a combination of a cross structure 1 and a rib structure 2, are coupled to a crossbar 3. The cross structure 1 supports in four directions and thus has a high supporting strength, so that the spacer can have a high aspect ratio and a stable structure. The rib structure 2 supports while minimizing portions which contact a substrate on a display screen, so that the spacer is not shown on the screen. The crossbar 3 connects several support structures (1+2) to each other, so that the spacer is treated as a single body.

Figure 3:
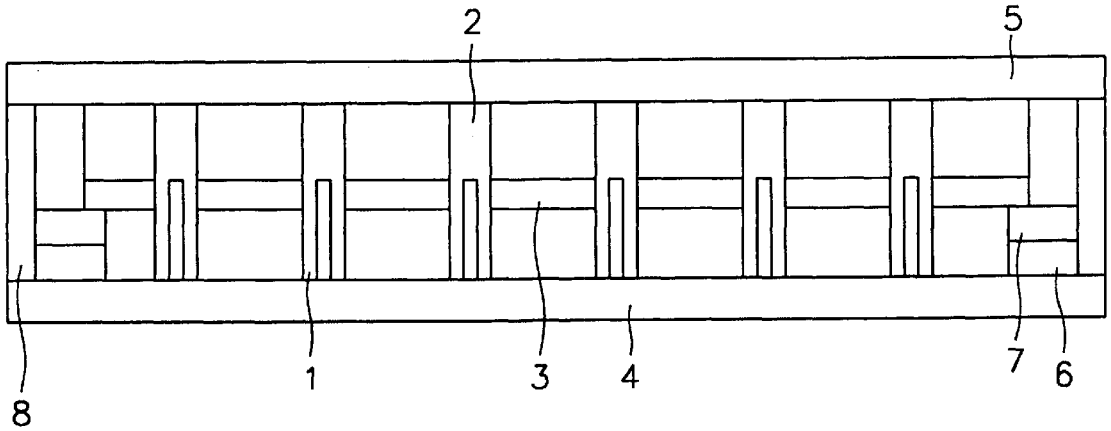
FIG. 3 is a cross-sectional view of the structure of a flat panel display device adopting the cross-rib type spacer structure of FIG. 2.

FIG. 3 is a cross-sectional view of the structure of a flat panel display device adopting the cross-rib type spacer of FIG. 2. As shown in FIG. 3, in the flat panel display device, the cross structure 1 is headed for a rear substrate 4 on which the cathode of a panel is formed, and the rib structure 2 is headed for a front substrate 5 on which an anode is formed, so that as small area as possible contact the front substrate 5 which corresponds to a display screen. In order to assemble a spacer within a panel, a frame 6 for fixing a spacer is formed on the rear substrate 4 on which a cathode is formed, the crossbar of the spacer is aligned and inserted, and the aligned spacer is attached to the frame using a paste 7.

After assembly of the spacer is completed, a side glass bar 8 made of frit glass is inserted between the rear substrate 4 and the front substrate 5 through a firing process, and then packaging is performed.

Figure 4:
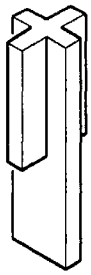
FIG. 4 is a perspective view of a second embodiment of a spacer structure using a cross structure according to the present invention.

FIG. 4 is a perspective view of a second embodiment of a spacer according to the present invention. As shown in FIG. 4, the second embodiment is made up for only the cross structure 1 and the rib structure 2 by removing the crossbar structure from the cross-rib type spacer according to the first embodiment.

Figure 5:
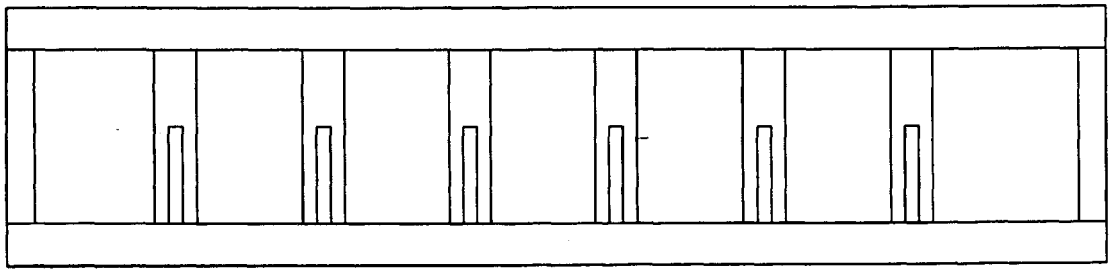
FIG. 5 is a cross-sectional view of the schematic structure of a flat panel display device adopting the second embodiment of FIG. 4 which is incorporated with a mesh.
Figure 11A:
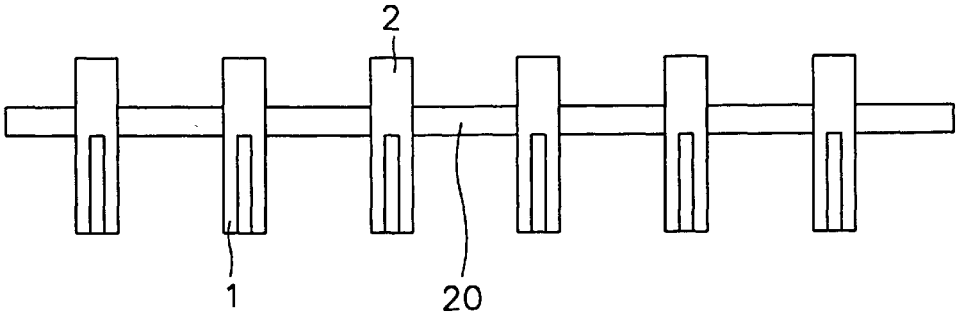
FIGS. 11A through 11G are cross-sectional views illustrating a method of assembling a flat panel display device in which the spacer of each embodiment is incorporated with a metal mesh for preventing arcing and adopted between panels.

FIG. 5 is a vertical cross-sectional view of a flat panel display device adopting the second embodiment of FIG. 4 which is incorporated with a mesh (not shown in FIG. 5; see FIG. 11A). The spacer according to the second embodiment does not require a fixing frame as shown in FIG. 3 during assembly since it has no crossbar in contrast with the first embodiment, and is coupled to holes formed in a mesh by fitting the mesh onto the cross structure 1. Then, the cross structure 1 is headed for the rear substrate 4. The spacer according to the second embodiment can be easily incorporated with a mesh, and is supported by a cross structure, so that the spacer is slightly subject to height restriction which is caused by the distortion of the mesh.

Figure 6:
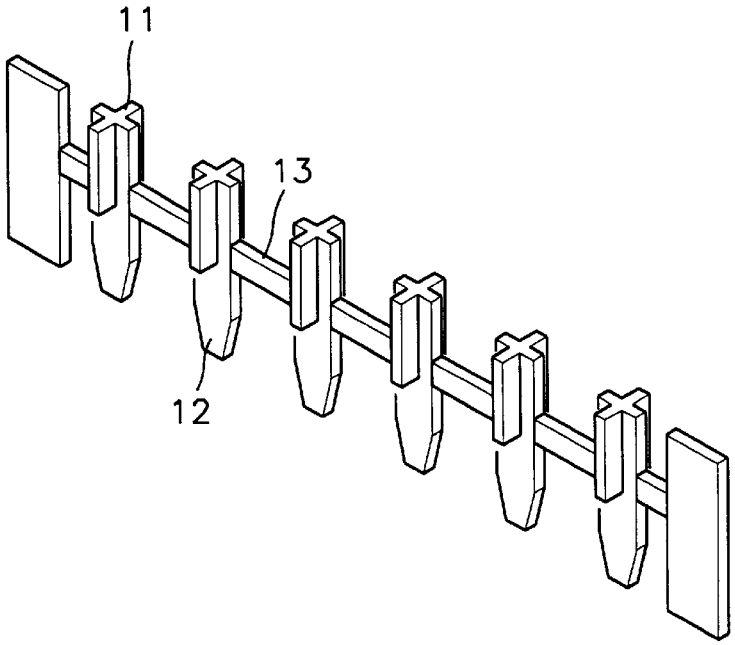
FIG. 6 is a perspective view of a third embodiment (a cross-trapezoid type spacer structure) of a spacer structure using a cross structure according to the present invention.

FIG. 6 is a perspective view of a third embodiment of a spacer according to the present invention. As shown in FIG. 6, the third embodiment has a cross-trapezoid structure in which a trapezoid rib structure is adopted instead of the rib structure in the first embodiment. That is, the third embodiment has a structure in which support structures (11+12), each of which is a combination of a cross structure 11 and a trapezoid rib structure 12, are coupled to a crossbar 13. The cross structure 11 supports in four directions and thus has a high supporting strength, so that the spacer can have a high aspect ratio and a stable structure. The trapezoid rib structure 12 in the third embodiment supports a substrate on a display screen while further reducing portions which contact the substrate than in the first and second embodiments, so that the spacer is not shown on the screen. The crossbar 13 connects several support structures (11+12) to each other, so that the spacer is treated as a single body.

Figure 7:
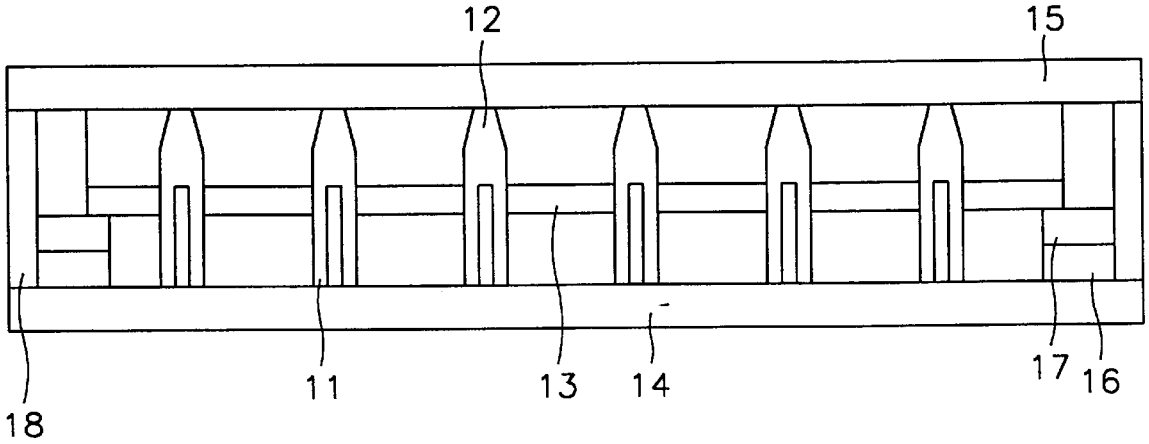
FIG. 7 is a cross-sectional view of the structure of a flat panel display device adopting the cross-trapezoid type spacer structure of FIG. 6.

FIG. 7 is a vertical cross-sectional view of the structure of a flat panel display device adopting the cross-trapezoid spacer according to the third embodiment. As shown in FIG. 7, in this flat panel display device, the cross structure 11 is headed for a rear substrate 14 on which the cathode of a panel is formed, and the rib structure 12 is headed for a front substrate 15 on which an anode is formed, so that as small area as possible contact the front substrate 15 which corresponds to a display screen. In order to assemble a spacer within a panel, a frame 16 for fixing a spacer is formed on the rear substrate 14, the crossbar of the spacer is aligned and inserted, and the aligned spacer is attached to the frame using a paste 17.

After assembly of the spacer is completed, a side glass bar 18 made of frit glass is inserted between the rear substrate 14 and the front substrate 15 through a firing process, and then packaging is performed.

Figure 8:
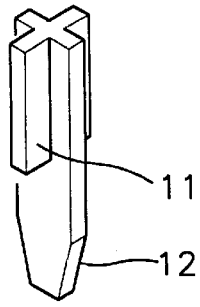
FIG. 8 is a perspective view of a fourth embodiment of a spacer structure using a cross structure according to the present invention.

FIG. 8 is a perspective view of a fourth embodiment of a spacer according to the present invention. As shown in FIG.

8, the fourth embodiment is made up for only the cross structure 11 and the trapezoid rib structure 12 by removing a crossbar structure from the cross-trapezoid type spacer according to the third embodiment.

Figure 9:
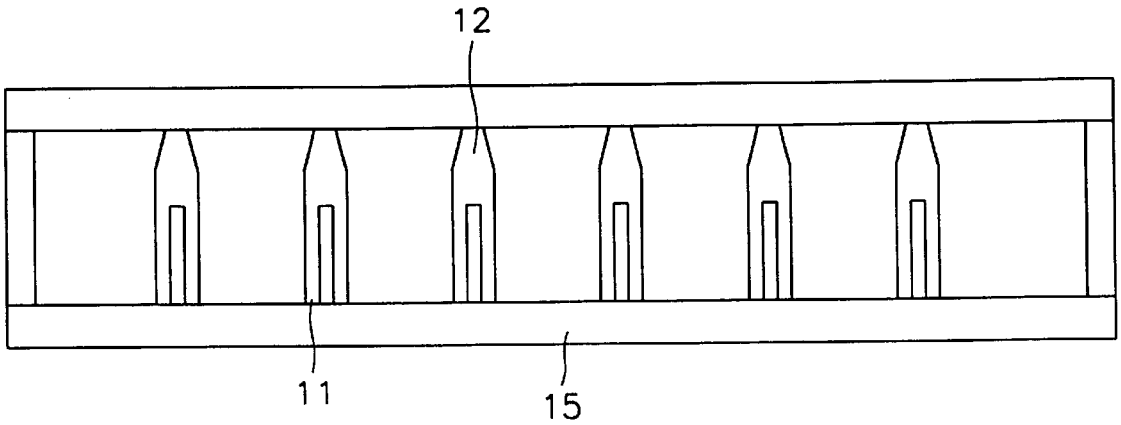
FIG. 9 is a cross-sectional view of the schematic structure of a flat panel display device adopting the fourth embodiment of FIG. 8 which is incorporated with a mesh.

FIG. 9 is a vertical cross-sectional view of a flat panel display device adopting the spacer according to the fourth embodiment which is incorporated with a mesh (not shown in FIG. 9; see FIG. 11A). The spacer according to the fourth embodiment does not require a fixing frame as shown in FIG. 7 during assembly since it has no crossbar in contrast with the third embodiment, and is coupled to holes formed in a mesh by fitting the mesh onto the cross structure 11. Then, the cross structure 11 is headed for the rear substrate 14. The spacer according to the fourth embodiment can be easily incorporated with a mesh and supported by a cross structure, so that the spacer is a little subject to height restriction which is caused by the distortion of the mesh.

A method of assembling the spacer structure according to each embodiment within a panel is the same, so a method of assembling the cross-rib type spacer according to the first embodiment will now be described with reference to FIGS. 10A through 10F.

Figure 10A:
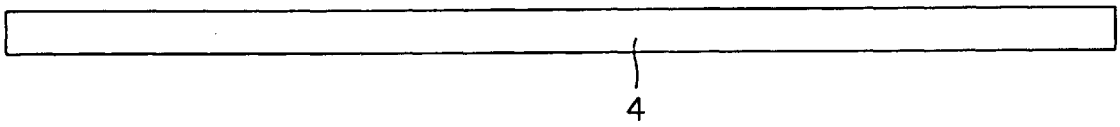
FIGS. 10A through 10F are cross-sectional views illustrating a method of assembling a flat panel display device adopting the spacer of each embodiment.
Figure 10B:
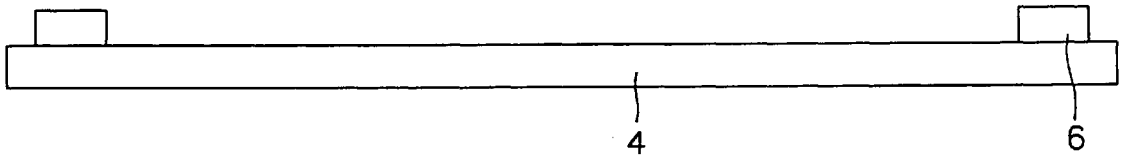
Figure 10C:
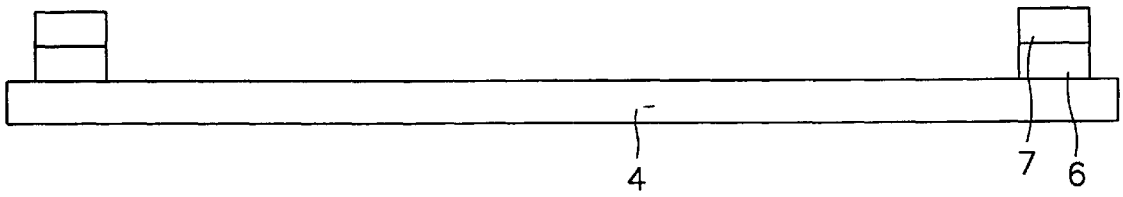

First, a rear substrate 4 is prepared for as shown in FIG. 10A, and a spacer fixing frame 6 is formed on the edge of the rear substrate 4 as shown in FIG. 10B. Then, a paste 7 is formed on the spacer fixing frame 6 as shown in FIG. 10C.

Figure 10D:
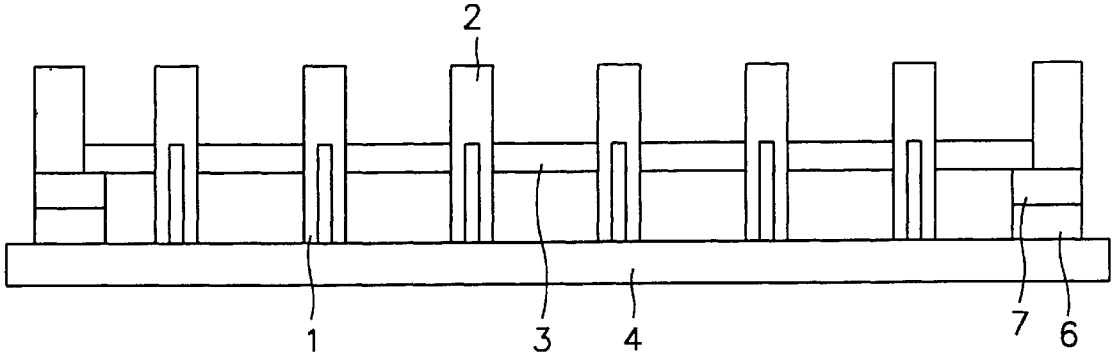
Figure 10E:
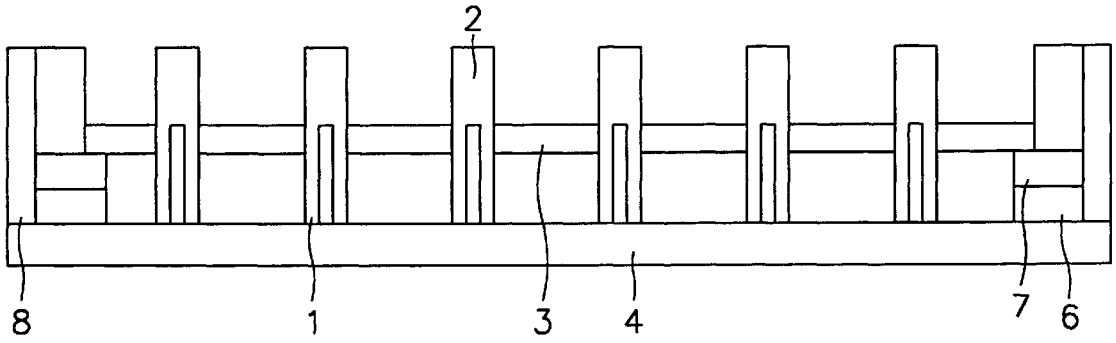
Figure 10F:
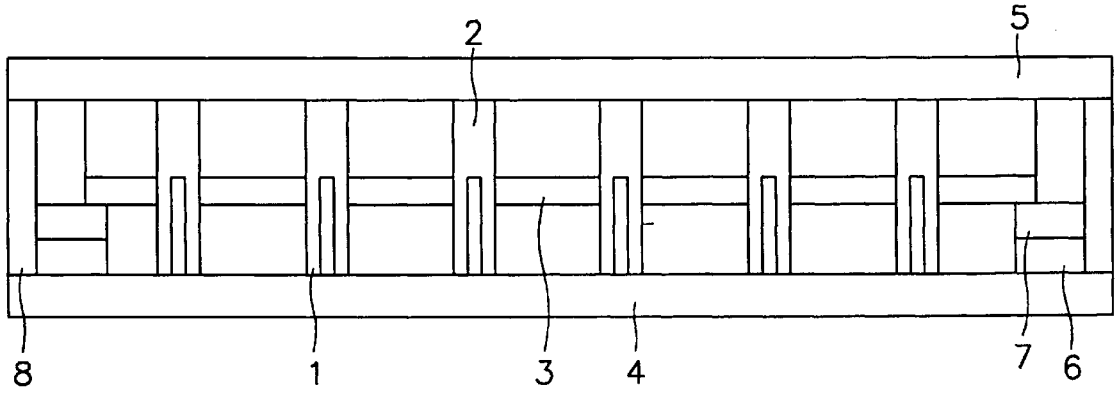

Next, the cross-rib type spacer is aligned on the resultant structure before the paste 7 is hardened, as shown in FIG. 10D. When the paste 7 becomes hard, side glass bars 8 are installed on the resultant structure, as shown in FIG. 10E. Thereafter, a front substrate 5 is put on the resultant structure as shown in FIG. 10F, and then packaging is performed.

FIGS. 11A through 11G are cross-sectional views illustrating a method of assembling a flat panel display device in which the spacer of each embodiment is incorporated with a metal mesh for preventing arcing and adopted in a panel.

First, as shown in FIG. 11A, a spacer is arranged so that a cross structure 1 looks downward, a metal mesh 20 is put on the cross structure 1 so that a rib structure 2 protrudes through the mesh 20. The mesh 20 is attached to the rib structure 2 by paste, so that it is incorporated with the spacer.

Figure 11B:
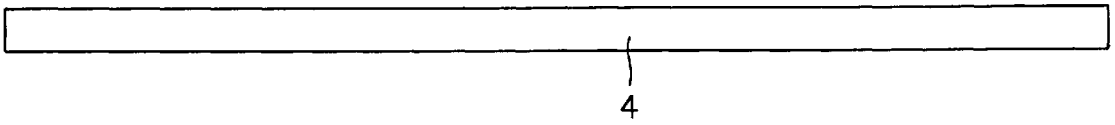
Figure 11C:
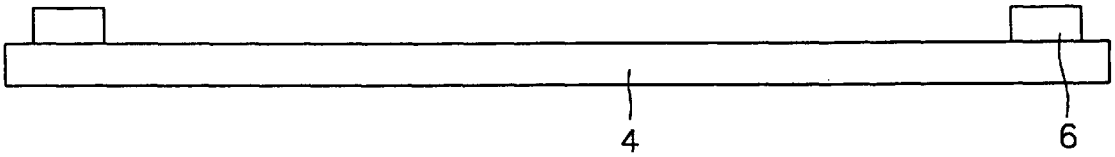
Figure 11D:
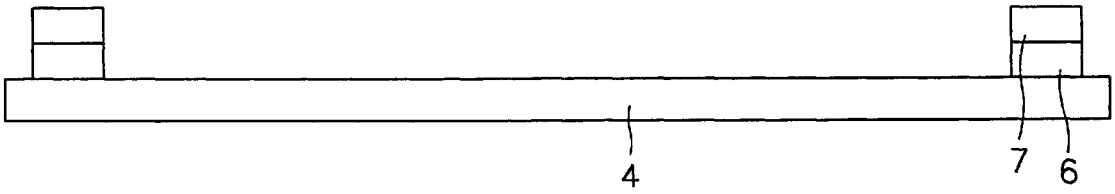

Next, a rear substrate 4 is prepared for as shown in FIG. 11B, and a spacer fixing frame 6 is formed on the edge of the rear substrate 4 as shown in FIG. 11C. Then, a paste 7 is formed on the spacer fixing frame 6 as shown in FIG. 11D.

Figure 11E:
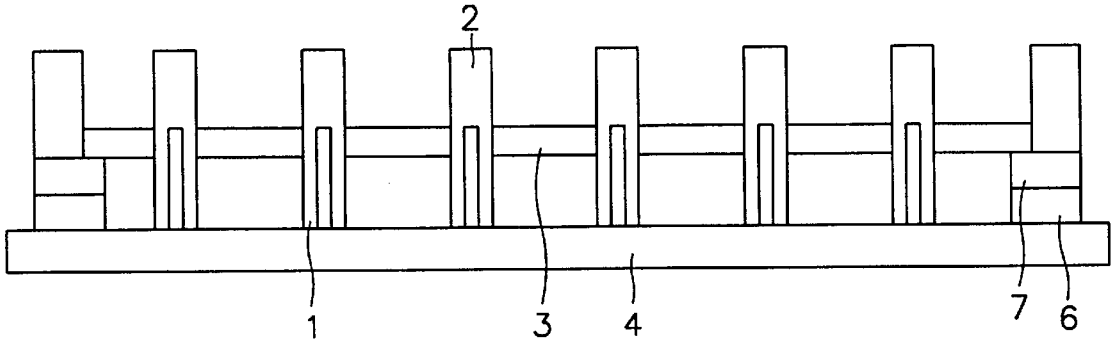
Figure 11F:
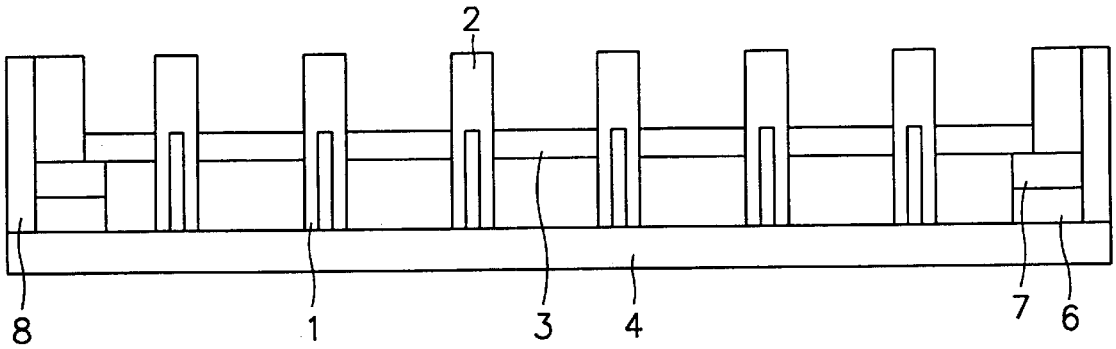
Figure 11G:
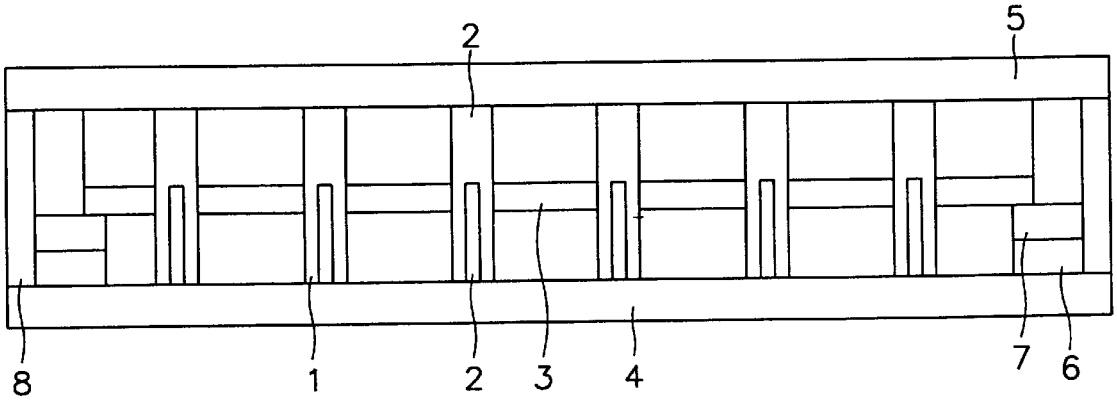

Thereafter, the spacer incorporated with the mesh 20 is aligned on the rear substrate 4 before the paste 7 is hardened, as shown in FIG. 11E. When the paste 7 becomes hard, side glass bars 8 are inserted in the resultant structure, as shown in FIG. 11F. Thereafter, a front substrate 5 is put on the resultant structure as shown in FIG. 10G, and then packaging is performed.

As described above, the present invention provides a cross-rib type spacer obtained by combining a cross structure and a rib structure, and a cross-trapezoid type spacer obtained by combining a cross structure and a trapezoid rib structure. These spacer structures facilitate enlargement of panels by increasing the supporting strength while maintaining a high aspect ratio. Also, while these types of spacers are incorporated with a metal mesh, the distance between the mesh and a substrate is freely controlled according to the length of a cross structure, thereby improving the focusing of emitted electrons.

In particular, when a display panel is large, a cross-type spacer having a high aspect ratio supports a substrate in all directions using a cross structure, so that the spacer has a stable structure. Thus, the spacer is not easily bent or broken. Also, an area which contacts a display screen is small, so that it is not shown on the display screen. Furthermore, the spacer can be easily incorporated with a mesh for preventing arcing by fitting the mesh on the cross structure. When the gap between the mesh and a substrate is controlled to achieve focusing, a restriction of gap control due to mesh distortion is relaxed by virtue of the support of the gross structure, so that the gap can be easily controlled. Due to the enlargement of a panel, greater reduction of the cross-section of the spacer may be restricted. However, a spacer an have a width of 50 $\mu$m or less by virtue of the supporting role of a combined structure of a cross structure and a rib structure.

Also, the height of a spacer can vary without restriction by controlling the height of a cross structure.

What is claimed is:

1. A spacer, comprising:

a support including:

a cross structure having a cross-shaped cross section;

a flat structure connected in axial alignment to the cross structure and having a rectilinear cross-section; and a connecting structure for holding the support comprised of the cross structure and the flat structure in alignment.

2. The spacer of claim 1, wherein the cross structure, the flat structure and the bar structure are formed of glass or ceramic.

3. The spacer of claim 2, wherein the connecting structure is a mesh.

4. The spacer of claim 2, wherein the flat structure is a rib.

5. The spacer of claim 1, wherein the connecting structure is a mesh.

6. The spacer of claim 1, wherein said flat structure is a trapezoid structure.

7. The spacer of claim 6, wherein said connecting structure is a mesh.

8. The spacer of claim 1, wherein the flat structure is a rib.

9. A flat panel display device comprising:

a front substrate on which anode stripes and a fluorescent material are located;

a rear substrate on which cathode stripes are located; and a spacer, wherein said spacer comprises:

a cross structure having a cross-shaped cross-section; and a flat structure connected in axial alignment to the cross structure; and a connecting structure for holding the support comprised of the cross structure and the flat structure in alignment, and wherein the flat structure of the spacer contacts the front substrate and the cross structure of the spacer contacts the rear substrate.

10. The flat panel display device of claim 9, wherein the cross structure, the flat structure and the bar structure are formed of glass or ceramic.

11. The flat panel display device of claim 10, wherein the connecting structure is a mesh.

12. The spacer of claim 10, wherein the flat structure is a rib.

13. The flat panel display device of claim 9, wherein the connecting structure is a mesh.

14. The flat panel display device of claim 9, wherein said flat structure is a trapezoid structure.

15. The flat panel display device of claim 14, wherein said connecting structure is a mesh.

16. The flat panel display device of claim 14, further comprising a spacer fixing frame located on the edge of the rear substrate to align said spacer, and a paste fixing the spacer to the spacer fixing frame, and a side glass bar made of frit glass located on an outer sidewall of the spacer fixing frame between the front substrate and the rear substrate.

17. The flat panel display device of claim 9, further comprising a spacer fixing frame located on the edge of the rear substrate to align said spacer, and a paste fixing the spacer to the spacer fixing frame, and a side glass bar made of frit glass located on an outer sidewall of the spacer fixing frame between the front substrate and the rear substrate.

18. The spacer of claim 9, wherein the flat structure is a rib.

19. A spacer comprising a plurality of supports, each support including a cross structure having a cross-shaped cross-section; and a flat structure connected in axial alignment to the cross structure; and a connecting structure holding the plurality of supports in alignment relative to each other.

* * * * *